US005357183A

United States Patent [19]

Lin

[11] Patent Number: 5,357,183

[45] Date of Patent: Oct. 18, 1994

[54] AUTOMATIC CONTROL AND SAFETY DEVICE FOR GARAGE DOOR OPENER

[76] Inventor: Chii C. Lin, 2700 N. Shannon Ave., Bethany, Okla. 73008

[21] Appl. No.: 37,328

[22] Filed: Mar. 26, 1993

Related U.S. Application Data

[63] Continuation-in-part of Ser. No. 832,797, Feb. 7, 1992, Pat. No. 5,247,232.

[51] Int. Cl.[5] ..... E05F 15/20

[52] U.S. Cl. ..... 318/468; 318/266; 318/286; 49/30

[58] Field of Search ..... 318/264, 265, 266, 267, 318/283, 286, 452, 466, 467, 468, 469, 470, 480; 49/25, 26, 29, 30, 31; 340/541; 250/206, 206.1

[56] References Cited

U.S. PATENT DOCUMENTS

| | | | |
|---|---|---|---|
| 3,783,556 | 1/1974 | Cook | 49/25 |
| 3,868,000 | 2/1975 | Spear et al. | 187/52 |
| 3,969,709 | 7/1976 | Isaacs et al. | 340/224 |
| 4,035,802 | 7/1977 | Pettersen et al. | 318/285 |
| 4,263,536 | 4/1981 | Lee et al. | 318/266 |
| 4,364,003 | 12/1982 | Phipps | 318/467 |
| 4,404,558 | 9/1983 | Yen | 340/825.72 |
| 4,463,292 | 7/1984 | Engelmann | 318/283 |
| 4,843,639 | 6/1989 | Beals | 455/603 |
| 4,922,168 | 5/1990 | Waggamon | 318/286 |
| 4,939,434 | 7/1990 | Elson | 318/285 |
| 5,136,548 | 8/1992 | Claar et al. | 367/2 |

*Primary Examiner*—Bentsu Ro

*Attorney, Agent, or Firm*—Dougherty, Hessin Beavers & Gilbert

[57] ABSTRACT

A control device for garage door opener to provide automatic reclose and safety reverse if obstruction occurs is disclosed. Photoelectric sensors are positioned across the door opening to detect the passage of a vehicle through the door and signal the device to reclose the door. The sensors also detect obstruction and reverse closing movement of the door or, otherwise, disable activation of movement. An oscillator causes the door to reclose if the door remained open for a predetermined time interval. Safety warning signal is generated shortly before the oscillator controlled reclosure.

9 Claims, 2 Drawing Sheets

AUTOMATIC CONTROL AND SAFETY DEVICE FOR GARAGE DOOR OPENER

This application is a continuation-in-part of application Ser. No. 07/832,797, filed Feb. 7, 1992, "Automatic Garage Door Control Device", now U.S. Pat. No. 5,247,232.

BACKGROUND OF THE INVENTION

1. Field of the Invention

This invention relates to powered overhead garage doors, or similar electrically operated systems, and in particular to an electronic control device that will automatically reclose the garage door after the vehicle exits or enters the garage if safety conditions are met.

2. Description of the Prior Art

Powered overhead garage doors, equipped with an electric motor to open or close the door by radio control units (receiver and transmiter) or by pushbutton switch on the garage wall, have gained popularity over the past decade. While the system works quite satisfactorily for some time, there are problems of unintentional opening by stray radio signal or by electrical or electromagnetic irregularities. Problems occur probably more often when the driver simply forgets to depress the control button to close the garage door. And most people had the experience of wondering if they have left the garage door open when they left home and have driven back to make sure. Furthermore, after entering the garage, people with tight space in the garage often have to walk to the rear of the vehicle to make sure it clears the door before pushing the control button to close it.

Numerous U.S. patents have been issued in the subject of reclosing a garage door, such as U.S. Pat. Nos. 4,939,434; 4,843,639; 4,463,292; 4,404,558; 4,364,003 and 4,035,702. These proposals attempt to reclose the garage door after it has been open for a selected time interval or according to some switch signals without safety precautions.

SUMMARY OF THE INVENTION

The primary object of this invention is to provide an automatic reclose for powered overhead garage doors after the vehicle exits or enters the garage. Another object is to provide safety reverse if obstruction occurs during the reclose movement. Yet another object is to provide automatic reclose if the garage door is inadvertently left open for a predetermined period of time, and also to provide a warning signal shortly before the garage door begins to close if it was left open for an extended period of time.

For the accomplishment of the above and related objects, the device employs a photoelectric seneor to detect the movement of a vehicle into or out of the garage. When a vehicle has entered or exited the garage, the photoelectric sensor will signal a delay timer to energize and then an activating timer will, in turn, activate a relay to cause the opener control unit to close the door. Other situations that do not involve the movement of a vehicle to cause the garage door to reclose are effected by an oscillator that produces a signal every five (5) minutes or so to cause the garage door to reclose if it remains open for whatever reason.

DESCRIPTION OF THE PREFERRED EMBODIMENT

Figure 1:
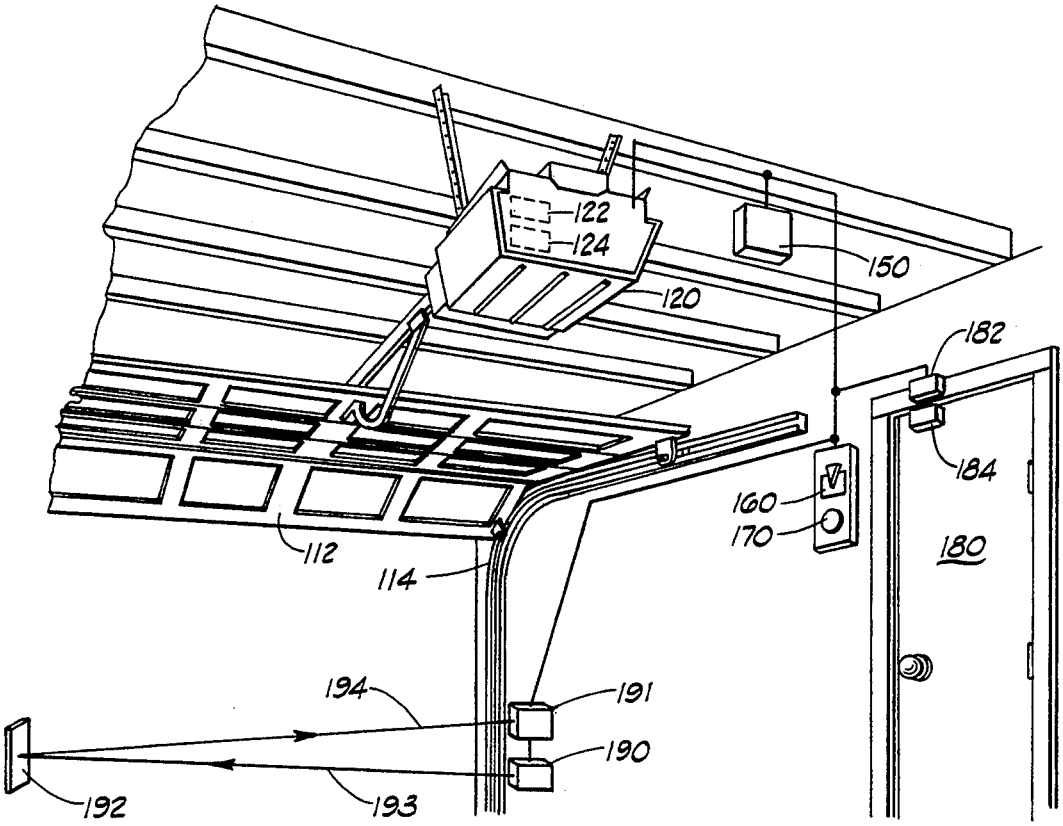
FIG. 1 is a perspective view of a powered overhead garage door incorporated with automatic reclose and safety device.

A powered overhead garage door with automatic reclose device is illustrated in FIG. 1. The garage door 112 is mounted for rolling movement on opposite side tracks 114 so that it can be raised or lowered by an electric powered opener control unit 120 through mechanical connections (chain, tape, drive screw, etc.) . Limit switches 122, 124 are provided inside the opener control unit 120 for correct setting of proper limits of down (close) or up (open) position of the garage door 112. A wall pushbutton 170 is usually mounted in a location near the service entrance door 180 for manual operation of the opener control unit 120.

The main part of the present invention is contained in the reclose logic box 150, which can be incorporated into the opener control unit 120 in future manufactures. A disable switch 160 is provided for the purpose of disabling partial reclose function if the door 112 is to remain open for an extended period of time. A service door switch 182, a normally open proximity switch, and a magnetic actuator 184 are mounted on the frame and door of the service entrance 180, respectively, to automate the function of the wall push buton.

The photoelectric sensor is employed to detect the movement of a vehicle into or out of the garage. Referring to FIG. 1, infra-red emitter 190 and infrared detector 191, preferably of the pulse modulated type, can be installed on one side of the door frame opening with a reflector 192 on the opposite side. The lower I-R beam 193 is to detect obstruction by pets or small children and the upper I-R beam 194 by a vehicle at its bumper height.

Figure 2:
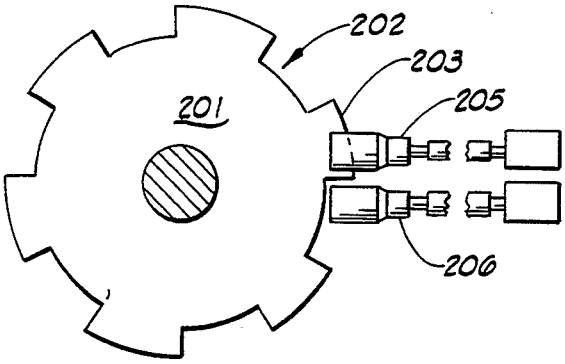
FIG. 2 is a diagram showing a disk and two optical switches for monitoring direction of a rotation.

FIG. 2 illustrates a widely used optical encoding arrangement, where a perforated disk 201 with perforations 202 on the rim to pulse the light beam of optical switch 205 or 206, available from Optek Technology Inc., to provide logical data associated with the rotation of the disk 201.

For safety control of the garage door movement, the direction of rotation for the electric motor that drives the door 112 must be monitored. The disk 201 is, therefore, attached to the motor shaft and the two optical switches 205 and 206 are positioned at the rim 203 to encode the perforations when the disk 201, and hence the motor rotates.

As shown in FIG. 2, if the disk 201 rotates counter clockwise, optical switch 206 is ON (bright) at the moment the other optical switch 205 changes its state from OFF (dark) to ON (bright). On the other hand, if the disk 201 rotates clockwise, optical switch 206 is OFF for the same change developed at optical switch 205.

Assuming clockwise rotation of the disk 201 represents closing movement of the garage door 112, the signal from optical switch 206 can then be connected to the reset terminal of a timer 307 (safety reverse timer, shown in FIG. 3) and the signal from optical switch 205 to the trigger terminal of said timer 307. A series of pulses will develop at the output terminal of the safety reverse timer 307, signifying that the door 112 is closing. If clockwise rotation of the disk 201 represents opening movement of the door 112, the signals from the two optical switches 205 and 206 merely need to be exchanged for the safety reverse timer 307 to function properly.

Figure 3:
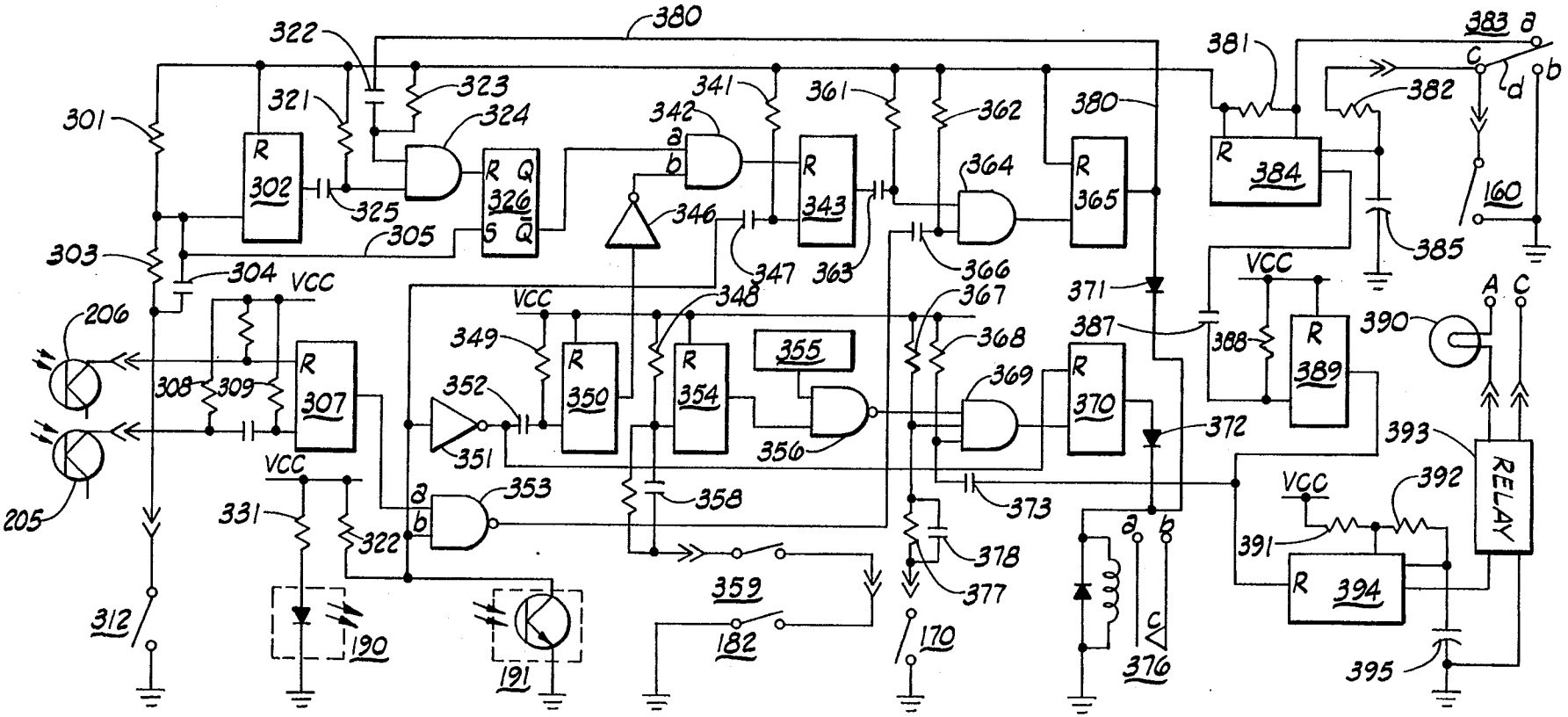
FIG. 3 is a schematic diagram of the automatic reclose and safety device for garage door opener.

Referring to FIG. 3, a UP limit switch 312 is installed in a convenient location (or to be incorporated into the limit switch assembly of the opener control unit 120 in future manufactures) to sense the fully open position of the garage door 112. At the moment the garage door 112 reaches its fully open position, the switch terminals make contact and cause the capacitor 304 and resistors 303 and 301 to produce a trigger signal for timer 302 (reclose enable timer). The trigger signal is also applied to the set terminal of flip-flop 326 through lead 305. The flip-flop 326 will then output a HI at its $\overline{Q}$ terminal to apply to lead 342*a* of AND gate 342 to provide an important and convenient safety feature that follows.

When the I-R beam 194 is blocked by an entering or exiting vehicle, the infrared detector 191 will output a HI. Inverter 351 will then delivers a LO to trigger timer 350 (safety timer). When the safety timer 350 energizes, inverter 346 will present a LO at lead 342*b* of AND gate 342, and therefore, a LO at the reset terminal of delay timer 343 to prevent it from energizing. The safety timer 350 is set to de-energize shortly before the vehicle clears the I-R beam 194. This will allow the vehicle to trigger a delay timer 343 but inhibit signals generated by small object, such as pets or human crossing the I-R beam 194, from causing unintended triggering.

With reclose enable signal HI and safety timer 350 de-energized, AND gate 342 will output a HI to enable energizing of delay timer 343 by a signal produced by the vehicle clearing the I-R beam 194. As the delay timer 343 de-energizes, a trigger produced by capacitor 363, resister 361 and AND gate 364 will energize timer 365 (activating timer) to activate a relay 376. Relay terminals 376*a* and 376*b* are connected to the opener control unit 120 at the same terminals as the wall pushbutton 170. Therefore, activation of the relay 376 will cause the garage door 112 to change its state of movement.

As the door 112 starts to close, optical switch 206 will supply a HI at the reset terminal of a timer 307 (safety reverse timer) at the moment when optical switch 205 changes its output from HI to LO. The safety reverse timer 307 is, therefore, energized and output a HI at the terminal 353*a* of NAND gate 353 which will output a LO if obstruction occurs that causes the terminal 353*b* of NAND gate 353 to go HI. The capacitor 366, resistor 362 and AND gate 364 will then energize activating timer 365 to cause the door movement to stop or reverse.

In normal operation, door 112 is opened and reclose enable signal is generated. A vehicle will then move through the door frame opening and then the activating timer 365 will energize to reclose the door 112. When the activating timer 365 de-energizes, the lead 380 , capacitor 322, resister 323 and AND gate 324 will reset flip-flop 326 and hence, the reclose enable signal. As the door 112 is closing, optical switches 205 and 206 will repeatedly energizing safety reverse timer 307 to provide safety reverse enable signal. The door 112 will reclose, the safety reverse timer 307 will de-energize in due time. If obstruction occurs during door closing movement, the safety reverse circuit will cause the door 112 to reverse.

Other situations of garage door opening is reclosed by oscillators 384 and 394, timers 389 and 370 and the associated circuits. Resistors 381 and 382 and capacitor 385 comprise the timing circuit for the oscillator 384. The components are selected for the osci11ator 384 to generate a low going pulse every five (5) or so minutes to energize timer 389 (warning enable timer), to provide a HI output that enables an oscillator 394 (warning oscillator) to conduct through a relay 393 and flash a warning device 390. As warning enable timer 389 de-energizes, capacitor 373 resistor 368 and AND gate 369 will trigger timer 370 to activate relay 376 to reclose the door 112. If the door 112 is closed, DOWN limit switch terminals 383*b* and 383*c* are closed, timing circuit is open, no oscillation occurs. If the door 112 is open, switch terminals 383*a* and 383*c* are closed, timing circuit is connected, the oscillatior 384 starts its timing cycle. A disable switch 160 is provided for the purpose of turning off the oscillator's function if so desired. Another alternative is to block the I-R beam 194 with any convenient object nearby. Existing pushbutton 170 is disconnected from the opener control unit 120 and rconnected as shown to triggering circuit of activating timer 370 as a safer control of the opener control unit 120 as the activating timer 370 is inhibitted from functioning if obstruction occurs.

A service door switch 182 is connected in series to a garage door closed switch 359, contacts are closed when the door 112 is closed, and then to the triggering circuit of a timer 354 (sound detector enable timer). When the service door is opened, the timer 354 is energized to allow passage of signal from a sound detector 355 through NAND gate 356 and AND gate 369 to energize activating timer 370 to cause the door 112 to open. The sound detector 355 is adjusted to detect only loud sound such as slamming shut of vehicle doors. While the sound detector enable timer 354 is energized, a driver entering the vehicle and shutting the door will cause the door 112 to open. This helps ensure the door 112 is open before ignition of the vehicle is started and allows the engine to warm up while the door 112 is opening.

What is claimed is:

1. An automatic control and safety device for powered garage door of the type having an electric reversible motor to raise and lower the door, comprising:

control relay means actuatable to closed position to enable a garage door to open or close;

control activating means energizable to provide an electrical signal output to activate said control relay means;

reclose control means responsive to passage of vehicle through the garage door for providing a signal to energize said control activating means, said reclose control means being not responsive to passage of an object distinctly smaller than a vehicle through the garage door; and safety reverse control means responsive to closing movement of said garage door and obstruction in the door way for changing the state of the movement of said garage door if said obstruction occurs, the closing movement of said garage door being monitored by two switching means and a movement monitoring circuit, the obstruction in the door way being monitored by a infrared beam across the garage door frame opening.

2. The device in accordance with claim 1 wherein said reclose control means includes:

reclose enable means for enabling reclosure of the garage door for a short period of time;

obstruction detection means comprised of photoelectric emitter and sensor mounted across the garage door frame opening, and interconnected to said control activating means for causing the garage door to reclose when the vehicle clears the garage door frame opening, or causing the closing movement of the garage door to reverse if obstruction occurs; and safety delay means in cooperation with said reclose enable means for inhibiting reclosure of the garage door if said obstruction detection means is energized for less than a selected period of time.

3. The device in accordance with claim 2, wherein said short period of time is 20 to 120 seconds and said selected period of time is 2 to 5 seconds.

4. The device in accordance with claim 1 wherein said safety reverse control means includes:

a perforated disk attached to the shaft of the electric reversible motor, said two switching means are responsive to perforations of said perforated disk;

door movement monitor means responsive to said two switching means for generating a pulsed signal for closing movement of the garage door and a steady LO signal for other state of movement of the garage door; and a NAND gate receiving signals from said door movement monitor means and, an obstruction detection means for interconnecting said door movement monitor means and said obstruction detection means to said control activating means.

5. An automatic control and safety device for powered garage door of the type having an electrical reversible motor to raise and lower the door, comprising:

control relay means actuatable to closed position to enable a garage door to open or close;

control activating means energizable to provide an electrical signal output to activate said control relay means;

oscillator and warning means for providing a first signal to enable the operation of a safety warning means and a second signal to energize said control activating means after the garage door is open for a predetermined period of time;

sound activated control means for energizing said control activating means when a service entrance door switch is activated and a vehicle door is slammed shut causing a loud sound; and obstruction detection means comprised of photoelectric sensors mounted across the garage door frame opening for controlling energization of said control activating means.

6. The device in accordance with claim 5 wherein said control activation means is not energizable if said obstruction detection means is energized.

7. The device in accordance with claim 5 wherein said oscillator and warning means comprises a first oscillator for providing a warning enable signal to energize a warning enable means, said warning enable means controls a second oscillator that provides a train of pulses to operate a warning device through a relay means, said warning enable means also provides a signal to energize said control activating means at the end of the warning enable signal, 8. The device in accordance with claim 7 wherein said first oscillator includes a DOWN limit switch means for grounding a terminal of said first oscillator to disable its function when the door is closed and reconnecting said terminal to a timing circuit of said first oscillator when the garage door is not closed.

9. The device in accordance with claim 5 wherein said sound activated control means comprises:

sound detection means for detecting only a loud sound including the slamming shut of a vehicle door;

sound control enable means energizable by a service door switch means only if the garage door is in the closed position; and a NAND gate for receiving signals from said sound detection means and said sound control enable means, and delivering its output to said control activating means.

* * * * *